United States Patent [19]

Carey

[11] 4,327,636

[45] May 4, 1982

[54] APPARATUS FOR MARKING AN ELONGATE ARTICLE

[75] Inventor: Richard D. Carey, Waynesville, N.C.

[73] Assignee: Dayco Corporation, Dayton, Ohio

[21] Appl. No.: 172,097

[22] Filed: Jul. 25, 1980

[51] Int. Cl.[3] ..... B41F 1/07

[52] U.S. Cl. ..... 101/29; 101/31; 101/93.05; 400/124; 219/216

[58] Field of Search ..... 101/18, 11, 13, 16, 101/3 R, 29, 31, 118, 93.05; 400/120, 124; 346/76 R; 219/216, 229

[56] References Cited

U.S. PATENT DOCUMENTS

| | | | |
|---|---|---|---|
| 3,405,392 | 9/1968 | Milne et al. | 400/124 X |
| 3,781,515 | 12/1973 | Morris, Jr. et al. | 219/216 |
| 3,797,629 | 3/1974 | Moser | 400/120 X |
| 3,850,278 | 11/1974 | Mihm et al. | 400/124 |
| 3,973,111 | 8/1976 | Washizuka et al. | 219/216 |
| 3,985,216 | 10/1976 | McIntosh | 219/216 X |
| 4,182,239 | 1/1980 | Timmins et al. | 101/29 X |
| 4,285,603 | 8/1981 | Bernardis et al. | 400/124 |

FOREIGN PATENT DOCUMENTS

| | | | |
|---|---|---|---|
| 2298438 | 8/1976 | France | 400/124 |

OTHER PUBLICATIONS

Clarke et al., "Integrated Polyacetylene Structure for Resistive Ribbon Thermal Transfer Printing", IBM Tech. Discl. Bull., vol. 21, No. 12, 5/79, p. 5011.

*Primary Examiner*—E. H. Eickholt
*Attorney, Agent, or Firm*—Joseph V. Tassone

[57] ABSTRACT

An apparatus for and method of marking an elongate article are provided wherein the apparatus comprises a device having electrically heated character means adapted to be imprinted on the article and the character means comprises a plurality of pins which have heated working ends normally disposed in a retracted position and the device has means for positioning selected ones of the pins to position the associated working ends thereof from the retracted position to a working position where the working ends of the selected ones of the pins cooperate and imprint a particular character on the article upon movement thereof in operative association with the article using moving means associated therewith.

9 Claims, 5 Drawing Figures

APPARATUS FOR MARKING AN ELONGATE ARTICLE

BACKGROUND OF THE INVENTION

1. Field of the Invention

This invention relates to a marking apparatus and method of marking elongate articles such as tubing, wire, and the like.

2. Prior Art Statement

Marking apparatus for elongate articles such as tubing, wire, and the like are well known in the art. A typical apparatus proposed heretofore uses a heated platen which includes heated characters which are urged toward the surface of an article to be marked sandwiching a marking tape therebetween to transfer a portion of the marking tape which corresponds to a character to be marked against the tape. Inherent with apparatus proposed heretofore is the concept that the characters must be of preformed fixed construction and design.

One example of a previously proposed marking apparatus is a hand-held apparatus sold by the Industrial Products Division of W. H. Brady Co., 2221 W. Camden Rd., P.O. Box 2131, Milwaukee, Wis. 53201 and sold as Model PM-1 under the registered trademark "PORTA-MARK." Another example of a similar hand-held apparatus is sold by NDC International, a Division of National Dynamics Corporation, 2075 Palos Verdes Drive North, Lomita, Calif. 90717, and under the trade name Hotmarker M-3.

However, inherent with the previously proposed apparatus is the fact that such apparatus are comparatively complex, are expensive, and have limited versatility based on the number of preformed characters.

SUMMARY

It is a feature of this invention to provide a marking apparatus for marking elongate articles such as tubing, wire, and the like which is of simple and economical construction yet has great versatility.

Another feature of this invention is to provide an apparatus of the character mentioned which utilizes a simple device having electrically heated character means to provide a comparatively large number of characters.

Another feature of this invention is to provide an apparatus of the character mentioned wherein the character means of the device comprises a plurality of pins with the pins having heated working ends normally disposed in a retracted position and means for positioning selected ones of the pins to position associated working ends thereof from the retracted position to a working position and wherein the working ends of the selected ones of the pins cooperate to imprint a particular character on the article upon movement thereof in operative association with such article.

Another feature of this invention is to provide an apparatus of the character mentioned wherein the plurality of pins are normally mechanically held in the retracted position by spring means and urged to the working position by suitable means overriding the spring means.

Another feature of this invention is to provide an apparatus of the character mentioned wherein the overriding means comprise electrical actuative devices and the positioning means of the apparatus comprises a control assembly which comprises a display panel for displaying each character means capable of being imprinted by the apparatus, a selector knob on the panel which is adapted to be positioned in alignment with each desired character means, and an electrical system operatively connected between the selector knob and the overriding means.

Another feature of this invention is to provide an apparatus of the character mentioned which also utilizes a tape of marking material rotatably supported on the apparatus and has an end portion adapted to be unwound and disposed between the article being marked and the heated working ends of the pins to enable imprinting the article by transferring portions of the tape corresponding in area to the working ends of the selected ones of the pins against the article.

Another feature of this invention is to provide an apparatus of the character mentioned which has means for axially indexing the article upon imprinting a particular character thereagainst in preparation for imprinting another character.

Another feature of this invention is to provide an improved method of marking an elongate article of the character mentioned.

Thereof, it is an object of this invention to provide an improved apparatus for and method of marking an elongate article having one or more of the novel features set forth above or hereinafter shown or described.

Other details, features, uses, objects, and advantages of this invention will become apparent from the embodiment thereof presented in the following specification, claims, and drawing.

BRIEF DESCRIPTION OF THE DRAWING

The accompanying drawing shows a present preferred embodiment of this invention, in which.

DETAILED DESCRIPTION

Figure 1:
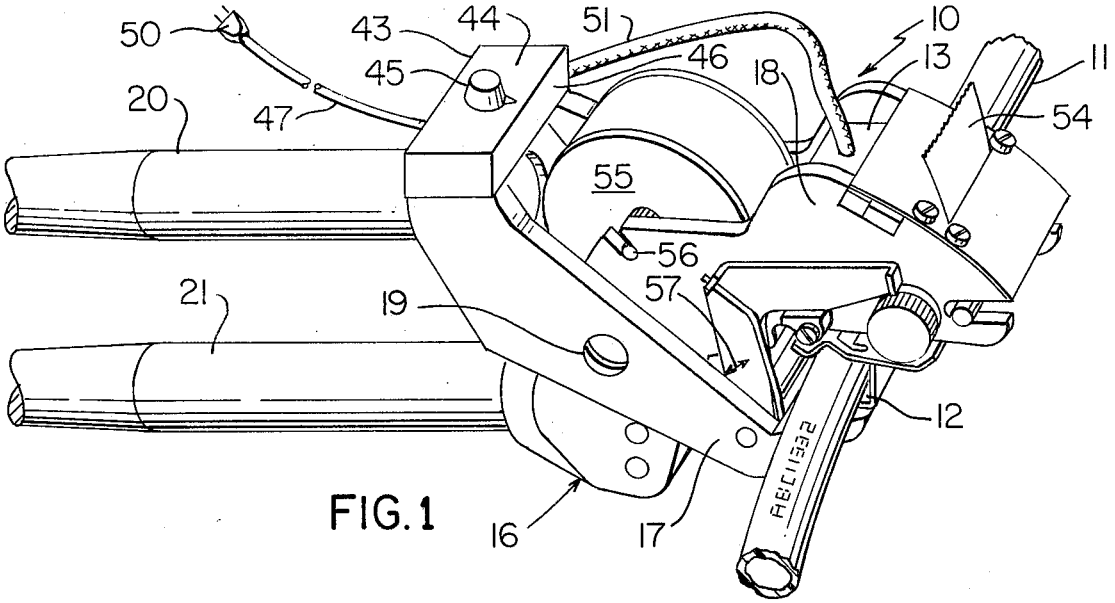
FIG. 1 is a perspective view with parts in cross section and parts broken away illustrating one exemplary embodiment of the apparatus and method of this invention.

Reference is now made to FIG. 1 of the drawing which illustrates an exemplary embodiment of the apparatus and method of this invention which is designated generally by the reference numeral 10. The apparatus 10 is particularly adapted for marking an elongate article which may be in the form of a wire, tube, or the like; and, each wire is generally an electrically insulated wire or cable. Each elongate article which may be marked by the apparatus 10 may be of any suitable cross-sectional configuration.

The exemplary apparatus 10 is shown in this disclosure being utilized to mark an elongate article or polymeric tube 11 which is shown by cross hatching as being made of a synthetic plastic material; however, the article 11 may be made of any suitable material.

Figure 2:
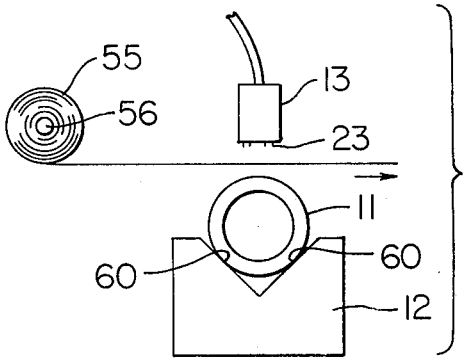
FIG. 2 is a schematic presentation basically highlighting the operation of the apparatus and method of this invention.
Figure 4:
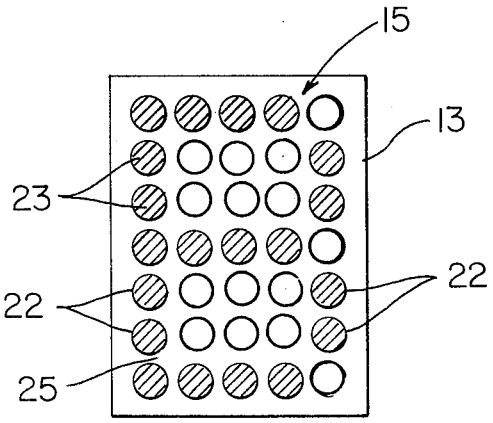
FIG. 4 is a view looking perpendicularly toward the ends of the pins of the above-mentioned component device using cross hatching to indicate pins which have been extended to the working position thereof and wherein the cross hatched extended pins define the letter B.

The apparatus 10 comprises an article backup structure or backup anvil 12 (which is also shown in the schematic presentation of FIG. 2) for supporting the article or tube 11 thereon and a device 13 having electrically heated character means 15, as best shown in FIG. 4, wherein such character means is adapted to be imprinted on the article 11.

The apparatus 10 has means 16 for moving the device 13 and its character means toward and away from the backup structure 12 and article or tube 11 supported thereon to enable imprinting the tube with desired character means. In this example of the invention the moving means 16 comprises a supporting structure 17 for the anvil 12 and a supporting structure 18 for the device 13 with the structures 17 and 18 being suitably pivotally connected by a pivot pin 19. The structure 17 has a handle 20 suitably fastened thereto and the structure 18 has a handle 21 also suitably fastened thereto to define a pliers-like arrangement so that upon moving the handles 20 and 21 toward and away from each other about the pivot pin 19 the device 13 is moved toward and away from the anvil 12 in a corresponding manner to enable imprinting the desired character means on the tube 11.

The device 13 is made in accordance with the teachings of this invention and comprises a plurality of pins each designated by the same typical reference numeral 22. The pins 22 have heated working ends 23 normally disposed in a retracted position as shown at typical locations 24 in FIG. 3 whereby such working ends have their terminal outer ends disposed substantially flush with a planar outside surface 25 of the device 13. The device 13 has means for positioning selected ones of the pins 22 to position associated working ends thereof from the retracted position to a working position. In accordance with the teachings of this invention the heated working ends 23 of the selected ones of the pins 22 cooperate to imprint a particular character on the article or tube 11 upon movement thereof by the moving means 16 in operative association with such tube.

Figure 3:
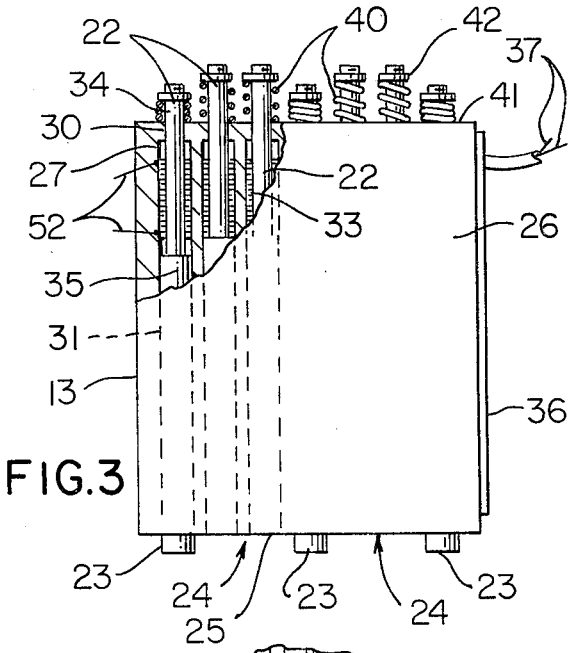
FIG. 3 is a view with parts in elevation, parts in cross section, and parts broken away particularly illustrating an exemplary component device of the apparatus of this invention wherein such device has electrically heated character means defined in accordance with the teachings of this invention by a plurality of pins.

As will be readily apparent from FIG. 3 of the drawing the device 13 comprises a support block 26 having a plurality of elongate openings 27 extending therethrough and each of the openings is defined by associated surface means slideably supporting an associated pin 22 for rectilinear reciprocating movement between the retracted and working position thereof. The surface means of each elongate opening 27 in this example of the invention comprises a right circular cylindrical surface 30 at one end portion of the support block 26 and an elongate right circular cylindrical surface 31 of greater axial length at the opposite end portion of the support block 26.

Each pin 22 is made of a magnetic material and serves as a movable core of a solenoid of conventional construction. In addition, the above-mentioned positioning means comprises a solenoid coil 33 associated with each pin 22 for moving each pin from the retracted position thereof to the working position which represents an extended position for the pin outwardly beyond the planar surface 25 of the device 13 and as shown for a plurality of pins in FIG. 3.

Each pin has cylindrical opposite end portions 34 and 35 which are slideably supported by surfaces 30 and 31 respectively comprising each elongate opening 27. Each pin 22 is also made of a metallic material which has comparatively high thermal conductivity and the support block 26 is provided with suitable heating means 36 shown schematically by a rectangular projection 36 extending from the support block 26. The heating means 36 is preferably in the form of an electrical heating device of conventional construction and in this example is a resistance heater having resistance heating elements which are supplied with electrical power by suitable electrical leads 37. The heating device 36 heats the entire metal support block 26 and thereby heats all pins 22 including the working ends 23 thereof. The dimensional tolerances of each pin 22 slideably supported in the support block 26 and the diameters of the cylindrical surfaces 30 and 31 of the support block 26 associated with each pin 22 are such that the pin 22 is free to move in an unobstructed manner yet each pin 22, and in particular each working end 23, is sufficiently heated to enable same to provide its imprinting function.

The device 13 has spring means for normally yieldingly holding its pins 22 in a retracted position; and, in this example of the invention the spring means comprises a plurality of compression springs with each compression spring being designated by the same reference numeral 40. Each compression spring 40 has an inner end engaging a top outer surface 41 of the support block 26 and an outer end engaging a washer-like snap ring 42 which is suitably supported against axial movement in a cooperating groove provided in the end of an associated pin 22. Each compression spring 40 acts between the pin 22 and block 26 and urges its pin 22 so that its working end 23 is in the previously described retracted position.

The positioning means also comprises a control assembly 43 and such control assembly includes a display panel 44 which displays each character means capable of being imprinted by the apparatus 10. The panel 44 has a selector knob 45 which is adapted to be positioned with its pointer aligned with each desired character means or character. The positioning means includes an electrical system indicated schematically by a block 46 within the assembly 43, and the system 46 is operatively connected between the selector knob 45 and the solenoids, and in particular the solenoid coils 33. The system 46 has integral circuit means enabling energizing of the appropriate solenoids to define the selected ones of the pins 22 and a particular character defined thereby as a function of the position of the selector knob 45 on the display panel 44. The control assembly 43 is provided with electrical power through a suitable electrical cable assembly 47 which has a plug 50 for connection thereof to a suitable power source. The electrical system 46 includes an electrical cable assembly 51 which supplies power to the solenoid coils 33 and such cable assembly 51 has the electrical leads 37 of the heating device 36 defined as a part thereof. Each solenoid coil 33 has leads 52 which comprise the cable assembly 51.

The apparatus 10 also comprises a tape of marking material which is designated generally by the reference numeral 54 and such tape is provided on a supply roll 55 thereof. The roll 55 is rotatably supported by a shaft 56 on the supporting structure 18 and the unwound leading end portion of the tape 54 is disposed between the article or tube 11 being imprinted and the device 13 whereby upon urging the heated working ends 23 of the selected pins 22 so that they sandwich the tape against the tube 11 corresponding portions of the sandwiched tape are imprinted against the tube 11.

The apparatus 10 has suitable tape roll indexing means of a type well known in the art for feeding a new portion of tape 54 in position to be imprinted against an elongate article, such as the tube 11, following each imprinting action. The tape indexing means is operatively connected to the handles 20 and 21 to provide indexing rotation of the tape roll 55 with each movement of the handles 20-21 away from each other.

The apparatus 10 also has suitable means designated generally by the reference numeral 57 and indicated schematically by a double arrow in FIG. 1 of the drawing and such means is provided for axially indexing the article or tube 11 upon imprinting a particular character thereagainst in preparation for imprinting another character. The indexing means 57 is also operated in conjunction with the movement of the handles 20-21 away from each other and as is known in the art.

As previously described the apparatus 10 comprises a backup structure in the form of an anvil 12 which is particularly adapted to support the cylindrical tube 11. The anvil 12 has a pair of cooperating planar surfaces 60 disposed to define a V-shaped surface and the V-shaped surface receives the cylindrical tube in nested relation therewithin and as highlighted in FIG. 2 of the drawing. A similar anvil having a similar V-shaped surface may be provided in supporting a wire or cable assembly which is to be imprinted in a similar manner as the tube 11; and, it will be appreciated that the supporting surfaces of a supporting anvil, or the like, may be modified so as to enable supporting articles of other shapes whether of circular cross-sectional configuration or noncircular cross-sectional configuration.

Figure 5:
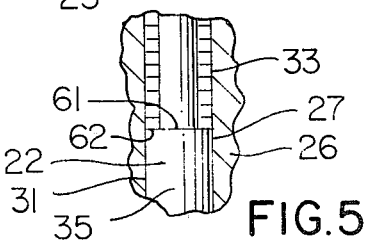
FIG. 5 is an enlarged fragmentary view particularly illustrating details of a particular pin and associated structure of the device of FIG. 3.

In this disclosure of the invention each pin 22 is yieldingly urged to a retracted position by spring means in the form of a compression spring 40, as previously described. As illustrated in the fragmentary view of FIG. 5 of the drawing each compression spring 40 serves to urge each pin 22 so that an annular shoulder 61 thereon engages a corresponding annular surface 62 of the support block 26 and limits the extent of movement of the associated pin 22 while simultaneously precisely positioning the terminal outer surface of the working end 23 of its pin so that it is disposed substantially flush with the planar surface 25 of the support block 26.

As described earlier, the positioning means comprises means overriding the compression springs 40 in the form of electrical solenoids as previously described. However, it will be appreciated that the positioning means may be suitable mechanical devices in the form of mechanical push buttons, or the like, which may be manually operated and locked in position once the springs 40 of the selected solenoids have been overridden.

In this disclosure of the invention a plurality of pins 22 of circular cross section are shown in the pattern illustrated in FIG. 4. However, it will be appreciated that the cross-sectional configuration of each pin may be non-circular, if desired. Further, regardless of the cross-sectional configuration utilized the important consideration is to assure that each pin 22 is freely axially movable in a reciprocating manner under the influence of an associated compression spring and the means overriding such compression spring. In addition, it is to be understood that the arrangement of the pins (whether of circular or noncircular configuration) may be such as to define any desired character means including Arabic numerals, symbols, English letters, and characters defined by members of the alphabets and number system of other countries including Japan, China, the Soviet Union, etc.

In this disclosure of the invention the spring means yieldingly urging the pins 22 to a retracted position consist of mechanical compression springs 40. However, it will be appreciated that any suitable spring means may be utilized for this purpose, whether primarily mechanical means or non-mechanical means.

It will also be appreciated that instead of heating the entire support block 26 to provide heating of the pins 22 and their working ends 23 it may be desired in some applications of this invention to modify the design of the support block 26 so as to heat only the terminal outer end portions of such pins adjacent the working ends 23. In this instance the pins 22 may be defined so that their working ends 23 are substantially thermally isolated from the main portions of the pins.

In practicing the method of this invention the cable assembly 47 is plugged into a suitable electrical power supply and supplies electrical power to the control assembly 43. The control assembly 43 in turn supplies electrical power to the electrical system 46 and hence solenoid coils 33 and heater 36 through the cable assembly 51. An elongate article such as the tube 11 is supported on the backup structure or anvil 12 so that the outside surface of the tube 11 is supported on the planar surfaces 60 defining the V-shaped surface. The selector knob 45 of the control assembly 43 is then set with its pointer opposite a character means or character (number or letter-not shown) provided on the display panel 44 and upon manually turning the knob to such character the electrical system 46 operatively connected between the selector knob 45 and the solenoid coils 33 serves to automatically energize integral electrical circuit means and the appropriate solenoids to define the selected ones of the pins and the set character. The handles 20 and 21 are then moved toward each other causing the preset character (defined by the selector pins 22 which are extended by the solenoid coils 33 overriding their associated compression springs 40) to be urged against the tape 54 sandwiching corresponding portions of the tape and imprinting the tape material against the tube 11. The handles 20 and 21 are then moved away from each other whereby the apparatus 10 provides axial indexing movement of the tube 11 and simultaneous indexing movement of the tape roll 51 as is known in the art. Another character is then set by movement of the pointer of the selector knob 45 to the desired position and the operation repeated.

In this disclosure of the invention, the apparatus 10 has been described utilizing a tape 54 wherein portions of such tape are imprinted against the tube 11. However it will be appreciated that the concept of this invention is fully applicable to the apparatus 10 being utilized without requiring a tape 54 (or the like) whereby the heated working ends 23 of the pins 22 may be urged directly against an elongate article to be imprinted and the imprinting action provided by, in essence, a heat embossing action directly against material defining the elongate article.

As described earlier the entire support block 26 is heated to heat the working ends 23 of the pins 22. It will be appreciated that with this construction each coil 33 is provided with suitable insulation to assure operation thereof at the high temperatures to which the support block is heated.

The apparatus 10 has been shown and described as a hand-held and hand operated apparatus; however, it is to be understood that the concept of this invention is fully applicable to floor or bench mounted apparatus for marking elongate articles.

While present exemplary embodiments of this invention, and methods of practicing the same, have been illustrated and described, it will be recognized that this invention may be otherwise variously embodied and practiced within the scope of the following claims.

What is claimed is:

1. In an apparatus for marking an elongate article comprising, a backup structure for supporting said article thereon, a device having electrically heated character means adapted to be imprinted on said article, and means for moving said device and its character means toward and away from said backup structure and article supported thereon to enable imprinting said article with desired character means, said character means comprising a plurality of pins, said pins having heated working ends normally disposed in a retracted position, and means for positioning selected ones of said pins to position associated working ends thereon from said retracted position to a working position, said working ends of said selected ones of said pins cooperating to imprint a particular character on said article upon movement thereof by said moving means, said device comprising a support block having opposed ends and a plurality of elongate openings extending therethrough, each of said openings being defined by associated surface means slidably supporting an associated pin for rectilinear movements between said retracted and working positions, the improvement wherein each of said openings has a large section interrupting one of said ends of said block and a small section interrupting the other of said ends of said block, each of said pins having a large section disposed in said large section of its respective opening and a small section disposed in said small section of its respective opening, said positioning means being respectively disposed in said large sections of said openings and respectively having shoulder means, said large section of each said pin having shoulder means for abutting said shoulder means of its respective positioning means when that respective pin is in its retracted position, said large section of each said pin having opposed ends one of which is said shoulder means thereof and the other end defining said working end thereof, said shoulder means being so constructed and arranged that said working end of each said pin is substantially flush with said one end of said block when that respective pin is in its retracted position.

2. An apparatus as set forth in claim 1 in which each of said pins is made of a magnetic material and serves as a movable core of a solenoid and said positioning means comprises a solenoid coil associated with each pin for moving same from the retracted position thereof to the working position thereof.

3. An apparatus as set forth in claim 2 in which each of said pins has cylindrical opposite end portions respectively defining said sections thereof and said surface means comprises spaced apart cylindrical surfaces.

4. An apparatus as set forth in claim 2 in which said working ends of said pins are made of a material having high thermal conductivity and further comprising means for heating at least a portion of said support block to thereby heat said working ends.

5. An apparatus as set forth in claim 4 in which said heating means comprises an electrical resistance heating device provided in said support block.

6. An apparatus as set forth in claim 1 and further comprising spring means for normally holding said pins in a retracted position and wherein said positioning means comprises means overriding said spring means and moving said working ends to said working position.

7. An apparatus as set forth in claim 6 in which said spring means comprises a mechanical compression spring associated with each pin.

8. An apparatus as set forth in claim 4 and further comprising a mechanical compression spring associated with each pin and wherein each solenoid coil is adapted to override its compression spring and move the working end of its pin to said working position.

9. An apparatus as set forth in claim 4 in which each solenoid coil has insulation enabling operation thereof at the high temperatures at which the support block is heated by said heating means.

* * * * *